US006651295B2

(12) United States Patent
Hodson

(10) Patent No.: US 6,651,295 B2
(45) Date of Patent: Nov. 25, 2003

(54) DOOR STOP

(76) Inventor: Ernest F. Hodson, 154 Governor Trumbull Way, Trumbull, CT (US) 06611

( * ) Notice: Subject to any disclaimer, the term of this patent is extended or adjusted under 35 U.S.C. 154(b) by 0 days.

(21) Appl. No.: 10/005,792

(22) Filed: Nov. 2, 2001

(65) Prior Publication Data

US 2002/0174513 A1 Nov. 28, 2002

Related U.S. Application Data

(60) Provisional application No. 60/293,426, filed on May 25, 2001.

(51) Int. Cl.[7] ..... E05F 5/06

(52) U.S. Cl. ..... 16/85; 16/82; 16/86 A

(58) Field of Search ..... 16/82, 85, 86 R, 16/86 A, 86 B, 86 C; 292/DIG. 15, DIG. 17, DIG. 19, 338, 330, 342

(56) References Cited

U.S. PATENT DOCUMENTS

| | | | | | |
|---|---|---|---|---|---|
| 318,323 | A | * | 5/1885 | Teetzel | 292/230 |
| 539,741 | A | * | 5/1895 | Ingram | 16/277 |
| 847,345 | A | * | 3/1907 | Leach | 292/230 |
| 1,704,967 | A | * | 3/1929 | Fuller | 292/338 |
| 2,449,686 | A | * | 9/1948 | Brinda | 16/85 |
| 3,006,676 | A | * | 10/1961 | Germock, Jr. | 292/338 |
| 3,809,419 | A | * | 5/1974 | Chezem | 292/338 |
| 3,831,989 | A | * | 8/1974 | Gurzenda | 292/338 |
| 4,244,081 | A | * | 1/1981 | Beyer et al. | 16/228 |
| 5,060,344 | A | * | 10/1991 | Cress | 16/332 |
| 5,135,273 | A | | 8/1992 | MacCalder | |
| 5,226,201 | A | * | 7/1993 | Lefebvre | 16/86 A |
| 5,282,658 | A | * | 2/1994 | Reeves, Jr. | 292/338 |
| 5,340,175 | A | | 8/1994 | Wood | |
| 5,515,575 | A | * | 5/1996 | Pinazza | 16/228 |
| 5,741,034 | A | | 4/1998 | Bains et al. | |
| 5,761,766 | A | * | 6/1998 | Basham | 16/85 |
| 5,815,899 | A | * | 10/1998 | Chao | 29/20 |
| 6,151,754 | A | * | 11/2000 | Chen | 16/85 |

* cited by examiner

*Primary Examiner*—Chuck Y. Mah
(74) *Attorney, Agent, or Firm*—John R. Doherty

(57) ABSTRACT

A door stop is provided comprising a first vertical plate for mounting to a wall and second horizontal pivot plate affixed to and extending outwardly from the wall-mounting plate. A third elongated member is pivotally mounted at its inner end to the pivot plate and at its outer end extends outwardly to a normal position perpendicular to the wall for making contact with a swinging door. A means is associated with the pivot plate for releaseably locking the third member in its normal position. In use, the door stop remains in its normal position until the elongated tube is struck by an object, such as a vacuum cleaner or mop. The impact releases the third member from its locked position and allows it to swing about its pivot point on the pivot plate to an out of the way position substantially parallel to the wall.

27 Claims, 6 Drawing Sheets

DOOR STOP

This application claims the benefit of provisional application No. 60/293,426 filed May 25, 2001.

FIELD OF THE INVENTION

The present invention relates to door stops in general and more particularly to door stops of the type which are mounted onto a wall, usually at the baseboard.

DESCRIPTION OF THE PRIOR ART

Wall-mounted door stops of the known type protrude outwardly from the wall and can be a nuisance to those performing normal maintenance or household cores, such as vacuuming, sweeping or mopping the floor. These door stops are often struck by vacuum cleaners, brooms, mops and the like and can be broken, damaged or loosened from the wall. They can also cause damage to the cleaning devices and injury to persons as well.

Door stops employing a helical coil are also know in the art. These door stops are able to move or bend laterally when struck by an object, such as a vacuum cleaner, and then return to their normal position once the force of the impact has been removed. The problem with this type of door stop is that the coil springs back quickly to its normal position, only to be struck again by the cleaning device. This repeated activity can be annoying to maintenance personnel who are usually forced to maneuver carefully around the door stop in order to avoid striking it again.

It is therefore an object of the invention to provide an improved door stop of the type which is mounted to a wall.

Another object of the invention is to provide a wall-mounted door stop which is designed to swing out of the way when struck by an object, such as a vacuum cleaner or mop, and then automatically or manually returned to its normal position without damaging itself or the object.

Still another object of the invention is to provide a wall-mounted door stop which can be moved temporally by maintenance personnel to a non-operative position essentially parallel to the wall and held in this position until the maintenance operation has been completed.

SUMMARY OF THE INVENTION

The present invention provides a door stop comprising a first vertical member for mounting to the wall. A second horizontal member is affixed to and extends outwardly from the first member and acts as a pivot plate. A third elongated member is pivotally mounted at its inner end to the second member and extends outwardly at its outer end to a normal position substantially perpendicular to the wall for making contact with a swinging door. A means is associated with the second member for releaseably locking the third member in its normal position.

In use, the door stop remains in its normal position until the third elongated member is struck by an object, such as a vacuum cleaner or mop, for example. The impact releases the third member from its locked position and allows it to swing about its pivot point on the second member to an out-of-the-way position, such as one that is substantially parallel to the wall.

In a preferred embodiment of the invention, the second member or pivot plate is formed along its outer edge with an arcuately shaped cam surface. A cam follower is provided at the inner end of the third elongated member and is biased into contact with the cam surface by a spring. When the door stop is struck by an object, the third elongated member is caused to rotate or swing in a direction towards the wall with the cam follower traveling along the cam surface. The cam surface is designed such that as the third elongated member approaches the wall, the follower is forced inwardly by the cam surface, compressing the spring which in turn forces the elongated member to return to its normal position.

In another preferred embodiment of the invention, the second horizontal member or pivot plate is formed with a notch on its outer periphery at a location such that when the third elongated member is pivoted in a direction toward the wall, the cam follower will engage the notch and hold the third member in a locked position, such as one that is close to and substantially parallel to the wall. This operation can be performed manually or it can occur unintentionally when the door stop is struck by an object.

DESCRIPTION OF THE PREFERRED EMBODIMENTS

Figure 1:
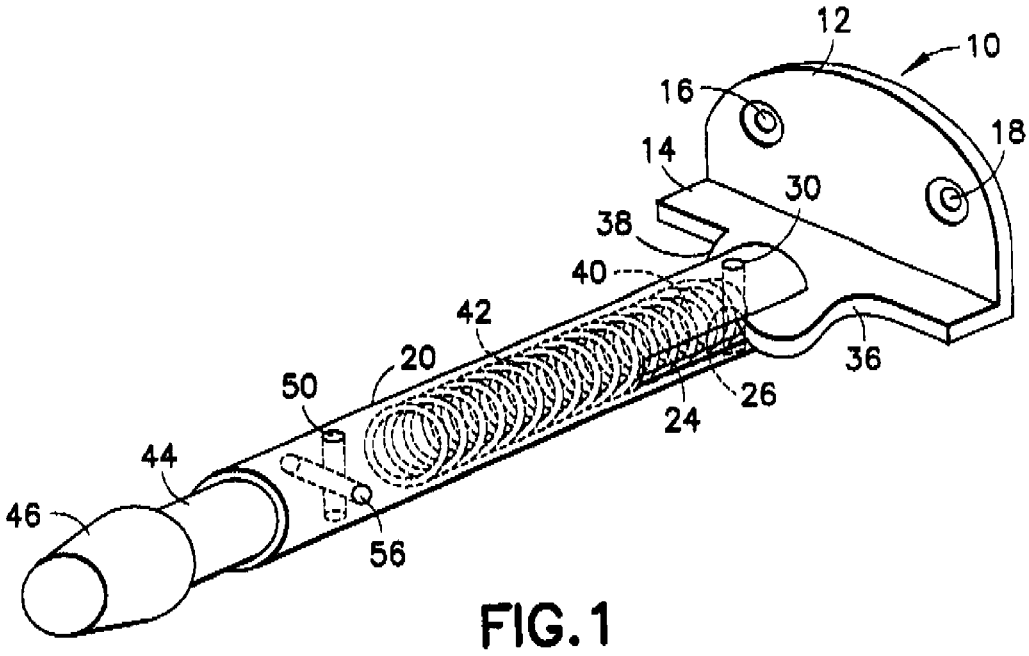
FIG. 1 is a perspective view of a door stop according to a preferred embodiment of the invention.

Referring now to the accompanying drawings, wherein like reference numerals refer to the same or similar parts, and particularly to FIGS. 1–7, inclusive, there is shown a door stop in accordance with a preferred embodiment of the invention. As shown, the door stop comprises a generally "L" shaped bracket 10, one leg of which constitutes a first vertical member or wall-mounting plate 12 and the other leg of which constitutes a second horizontal member or pivot plate 14. The mounting plate 12 has a pair of holes 16, 18 for mounting the door stop to a wall or baseboard using a pair of screws (not shown). The bracket 10 need not of course be "L" shaped but can be of other shapes such as "T" shaped, for example.

Figure 2:
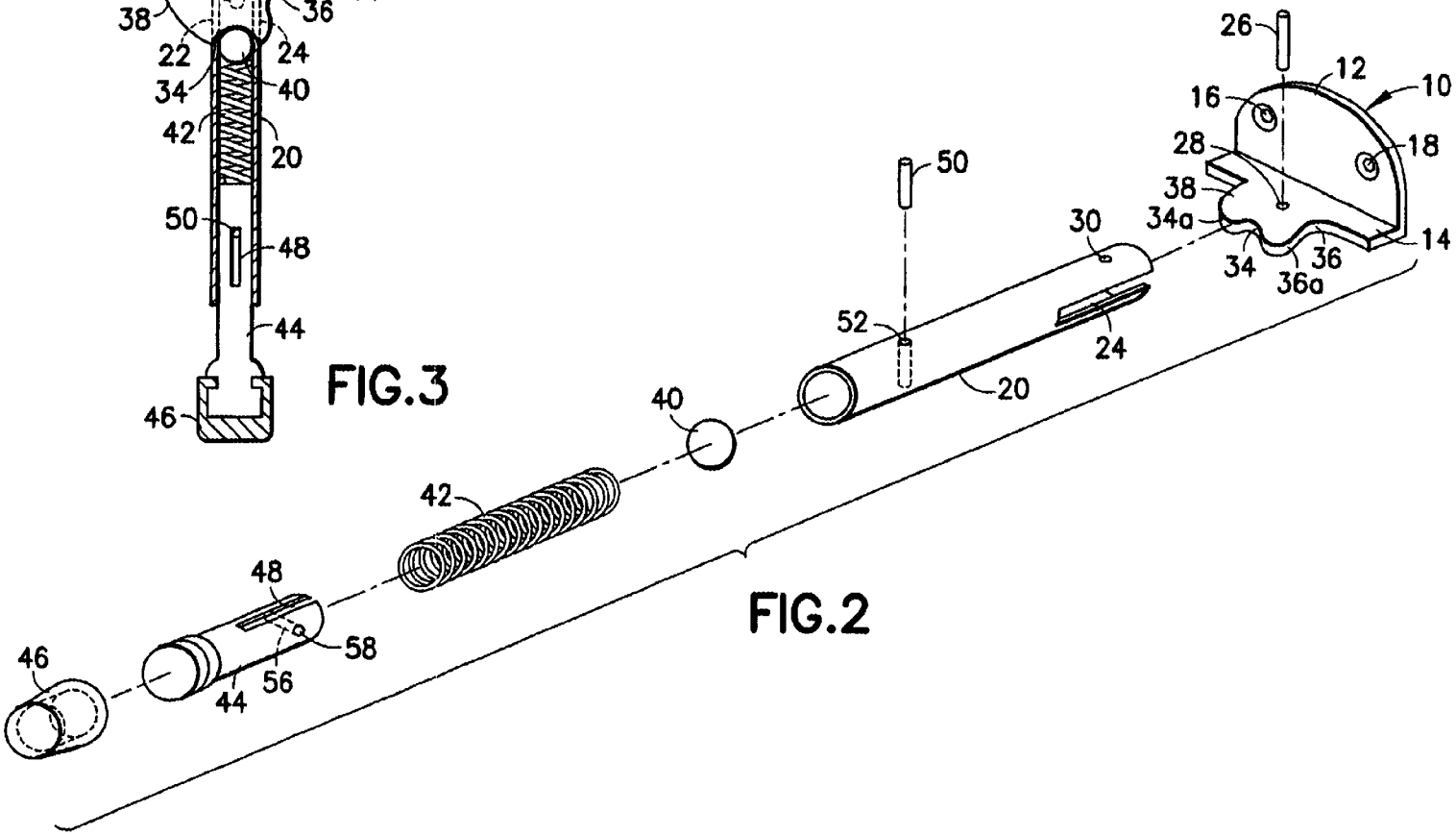
FIG. 2 is an exploded view of the door stop shown in FIG. 1.
Figure 3:
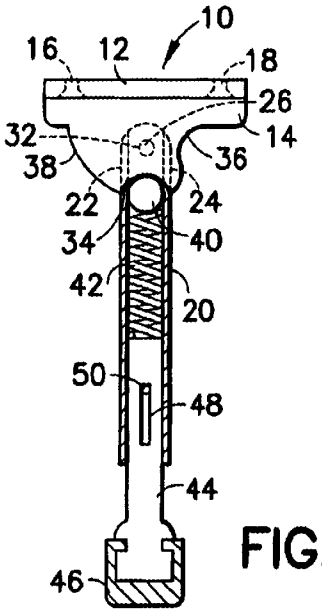
FIG. 3 is a top plan view of the door stop shown in FIGS. 1 and 2.
Figure 4:
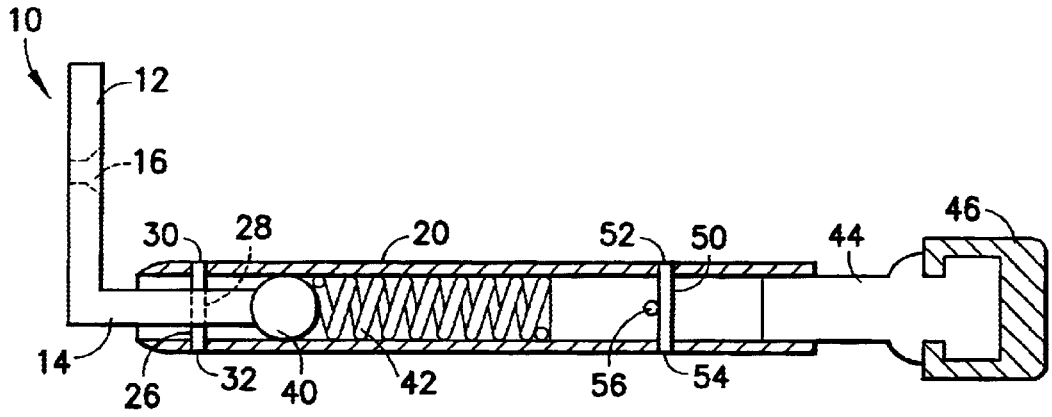
FIG. 4 is a side elevational view of the door stop.
Figure 5:
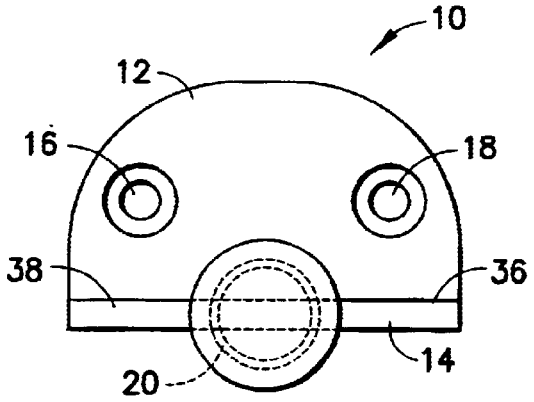
FIG. 5 is a front view thereof.

A third elongated member or hollow tube 20 is provided and has a pair of elongated rectangular slots 22, 24 on opposite sides forming a yoke at its inner end for fitting the tube 20 around the periphery of the pivot plate 14. The pivot plate 14 is arcuately shaped at its periphery as shown in FIGS. 1, 2 and 3 to accommodate movement of the tube 20. The tube 20 is pivotally mounted to the plate 14 using a pivot pin 26 passing through a pivot hole 28 in the plate 14. The pivot pin 26 fits through a pair of aligned holes 30, 32 within the inner end of the tube 20. It will be seen by this arrangement that the tube 20 is free to rotate 180 degrees about the pivot pin 26 from one to the other side of the pivot plate 14.

A pair of notches are formed within the periphery of the plate 14 as shown at 34, 36. The first notch 34 is located along the central axis of the plate in alignment with the pivot hole 28. The second notch 36 is located approximately 90 degrees to one side of the first or center notch 34, in this embodiment, to the right side facing the bracket 10.

A cam surface 38 is also formed along the outer periphery of the pivot plate 14 on the opposite or left side of the first notch 34. The cam surface 38 is in the shape of an arc formed about the pivot hole 28 in such manner that the radial or radial distance of the arc from the pivot hole 28 increases with increasing distance from the center notch 34 as best shown in FIG. 3.

A cam follower in the form of a roller ball 40 is mounted inside the inner end of the tube 20 along with a coil spring 42. The spring 42 biases the roller ball 40 into contact with the first or center notch 34, locking the tube 20 into its normal position perpendicular to the mounting plate 12.

A cylindrical member or cushion rod 44 is telescopically fitted inside the outer end of the tube 20. This rod has attached to its outer end a resilient bumper 46 for making contact with a door as it swings toward the wall.

The cushion rod 44 has an elongated slot 48 in its innermost end as best shown in FIG. 2. A guide pin 50 extends vertically through the tube 20 and passes through the slot 48 in the rod 44. The pin 50 is mounted through holes in the tube 20 as shown at 52, 54. A second or retainer pin 56 extends through a hole or bore 58 provided in the innermost end of the rod 44. The retainer pin 56 is located behind the guide pin 50 and limits outward movement of the cushion rod 44. This arrangement at the same time allows the rod to thrust inwardly against the spring 42 absorbing the shock created by the door striking the bumper 46.

Figure 6:
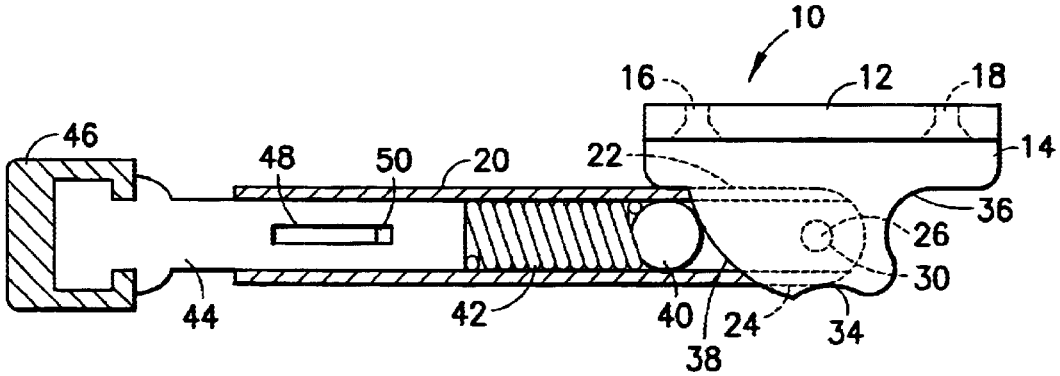
FIG. 6 is a view similar to FIG. 3 but showing the third elongated member rotated to the left side of the pivot plate.

Occasionally, during maintenance work, the door stop of the invention may be struck by an object other than a door, such as a vacuum cleaner or mop. Typically, the impact will occur at an angle to the tube 20 forcing the roller ball 40 out of engagement with center notch 34 and allowing the tube to swing about the pivot pin 26 in one of two directions, say to the left along the cam surface 38 as shown in FIG. 6. As the ball 40 travels along in contact with the cam surface 38, the ball will be gradually forced inwardly by the increasing radius or curvature of the arc about the pivot hole 28 as previously described. This action compresses the spring and forces the tube 20 to swing back to its normal position with the ball 40 again engaging the notch 34 once the impacting object has been withdrawn.

Figure 7:
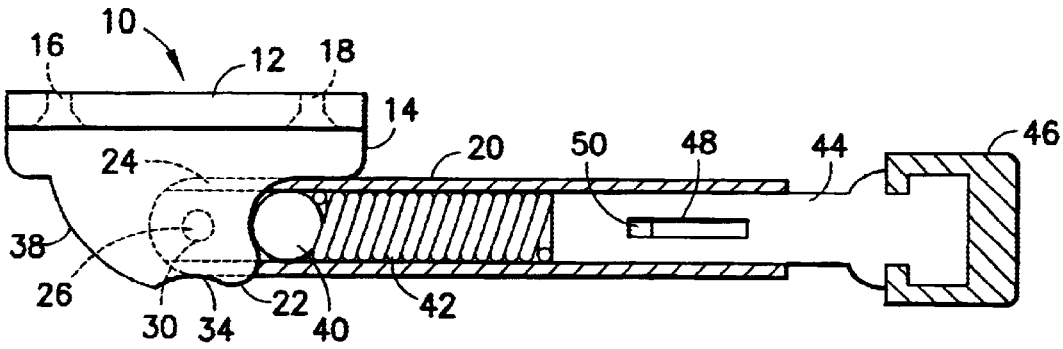
FIG. 7 is a similar view showing the third elongated member rotated to the opposite right side of the pivot plate.

If, on the other hand, the impact forces the tube 20 to swing to the right of the center notch 34, the tube will not encounter any bias exerted by the spring 44 and will come to rest in a position substantially parallel to the wall as shown in FIG. 7. The tube 20 will then be locked in this position by the engagement of the roller ball 40 with the second notch 36. This may, of course, only be temporary since the tube 20 can be easily released manually and returned again to its normal perpendicular position. It should be noted that both the first and second notches 34 and 36 (as well as all other notches herein mentioned) are provided with smooth curved edges as opposed to sharp edges as best shown at 34*a* and 36*a* in FIGS. 2 and 9, for instance. This feature is significant in that it facilitates both engagement and release of the roller ball as the tube 20 travels from one notch to the other notch.

It may be expedient in certain cases to manually swing the tube 20 to the left toward the second notch 36 where it can be locked temporarily in its parallel to the wall position to keep it out of the way and free from contact with cleaning devices during maintenance operations.

Figure 8:
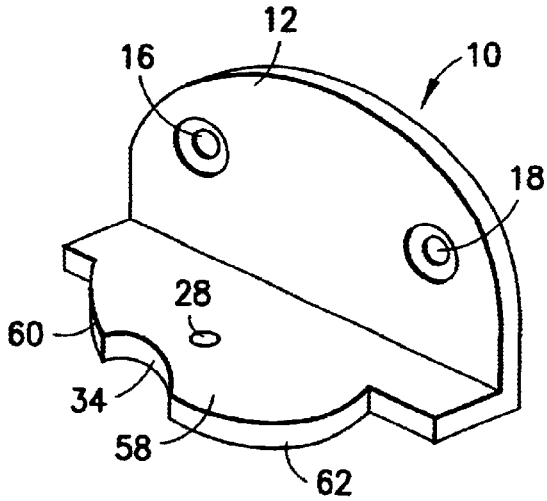
FIGS. 8 and 9 are perspective views of two modified pivot plates.

FIG. 8 shows a modified pivot plate 58 for use in the door stop of the invention. This pivot plate has two cam surfaces 60, 62, one on each side of the center notch 34. The cam surfaces are the same configuration as the cam surface 38 but, in this instance, the additional cam surface 62 is a mirror image of the cam surface 60. It will be seen that with this modification the tube 20 when impacted by an object can swing to either side of the central notch 34 and then be returned automatically to its normal position perpendicular to the bracket 10.

Figure 9:
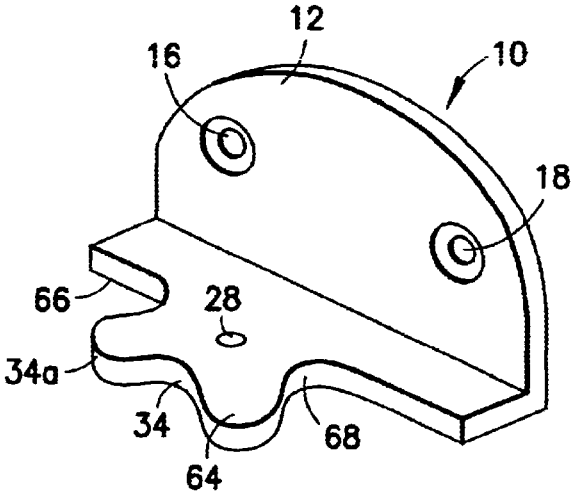

A similar modification is shown in FIG. 9 wherein the pivot plate 64 has two notches 66, 68 disposed substantially 180 degrees apart on its outer periphery. These notches are used in conjunction with the roller ball 40 to lock the tube 20 on either side of the bracket 10 in an out of the way position, parallel to the wall similar to that shown in FIG. 7.

Figure 10:
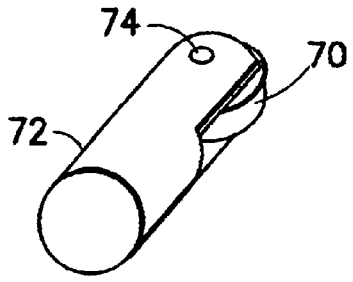
FIG. 10 is a similar view showing a modified cam follower.
Figure 11:
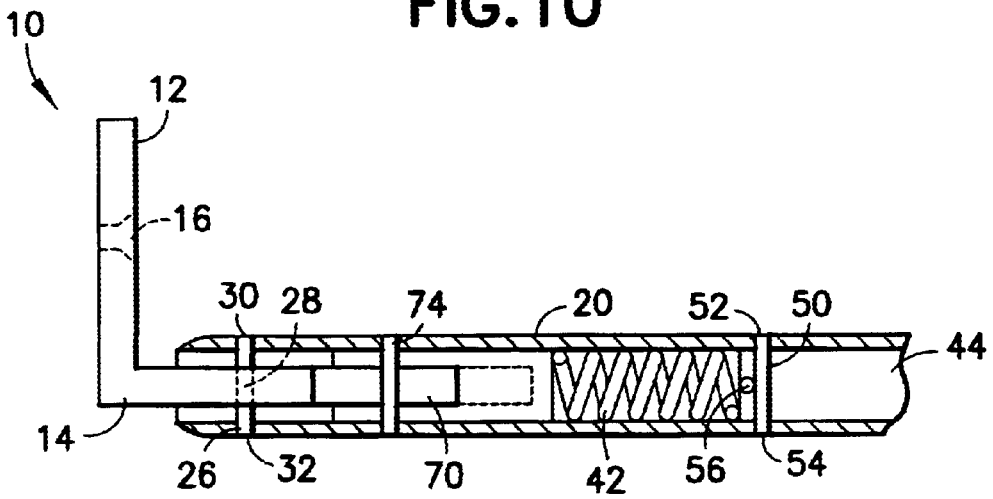
FIG. 11 is a side elevational, fragmentary view of a door stop employing the modified cam follower of FIG. 10.
Figure 12:
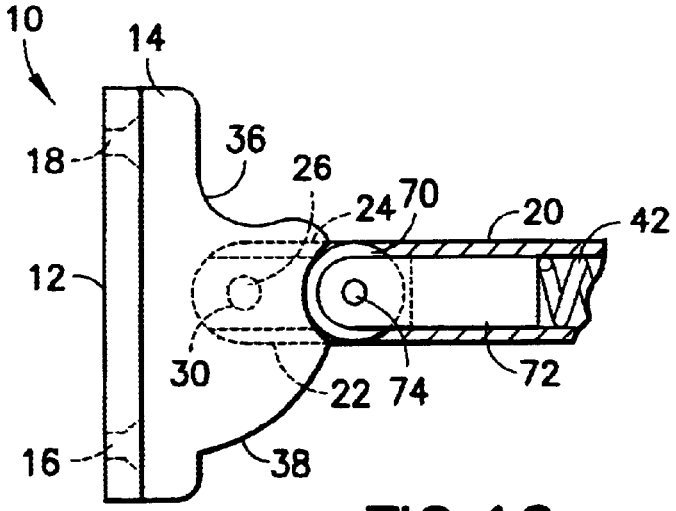
FIG. 12 is a top plan view thereof.

FIGS. 10–12, inclusive, show another modification in which the roller ball follower 40 is replaced by a wheel 70. The wheel 70 is mounted within the slotted end of a cylindrical member 72 by a pin 74. The coil spring 42 exerts pressure on the cylindrical member 72 which in turn keeps the wheel 70 in contact with the center notch 34 as more particularly shown in FIGS. 11 and 12.

Figure 13:
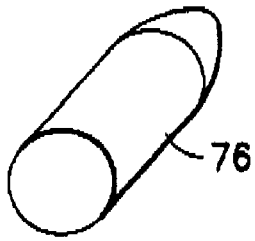
FIG. 13 is a perspective view of another modified cam follower.
Figure 14:
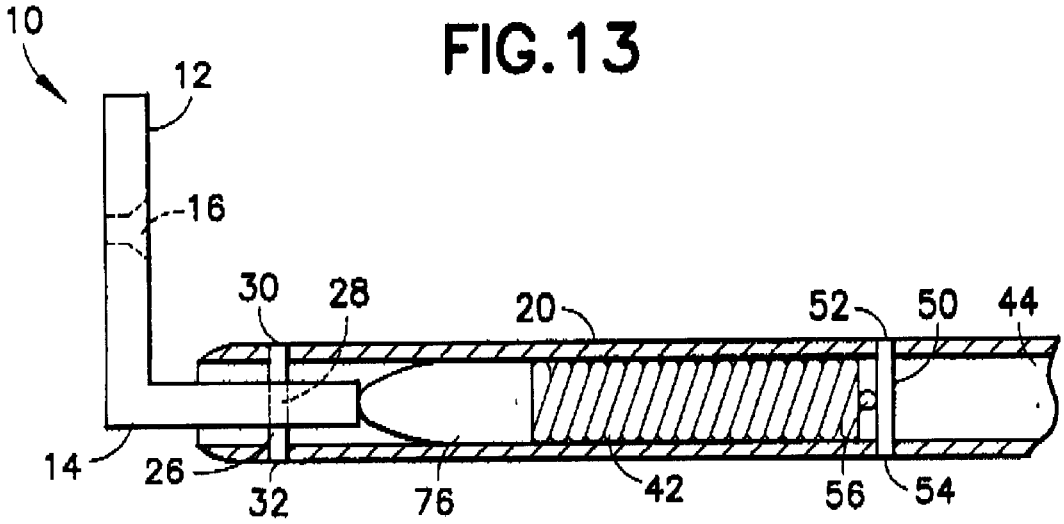
FIG. 14 is a side elevational, fragmentary view of a door stop employing the modified cam follower shown in FIG. 13.

A pointed cylindrical member 76 may also be used as the cam follower as shown in FIGS. 13 and 14. The pointed end of the cylinder is again kept in contact with the notch 34 by the coil spring 42.

Figure 15:
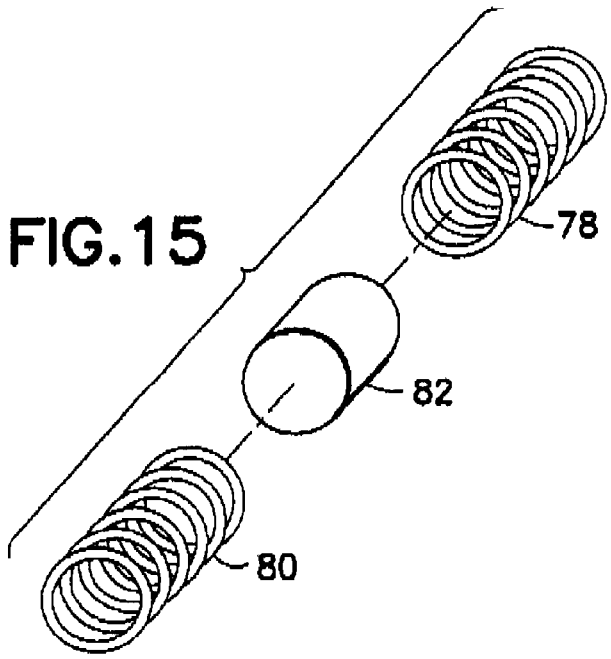
FIG. 15 is an exploded view of a modified spring arrangement for use in the door stop shown in FIGS. 1–7, 11, 12 or 14.

In all of the embodiments of the door stop so far described herein, a single spring member 42 is used to exert a bias pressure against both the cam follower 40 and the bumper rod 44 at opposite ends of tube 20. Although this arrangement is indeed expedient and useful in most instances, it is entirely possible to employ separate bias members or springs for each of these components as shown more particularly in FIG. 15. Here, two coil springs 78, 80 separated by a solid cylinder 82 are used to replace the single coil 42 inside the tube 20. The first spring 78 exerts a bias pressure against the cam follower or ball 40 at one end of the tube while the second spring 80 exerts a bias pressure against the cushion rod 44 at the opposite end of the tube. This arrangement has the advantage in that a heavier coil spring 80 may be utilized to absorb the shock when the swinging door impacts against the bumper 46 while at the same time employing a lighter coil spring 78 to exert bias pressure against the cam follower or roller ball 40. In such an arrangement, it would be necessary to fix the solid cylinder in place inside the tube 20, such as by means of a locating pin or the like.

What is claimed is:

1. A door stop comprising:

a first vertical member;

a second horizontal member extending outwardly from said first member;

a third elongated member extending outwardly from said second member in a normal position substantially perpendicular to said first member, means for pivotally mounting said third member to said second member at an inner end thereof whereby said third member is able to swing in a direction away from said normal position;

a follower mounted to said inner end of said third member;

a first means associated with said second member and cooperating with said follower for releaseably locking said third member in said normal position;

a second means associated with said second member and cooperating with said follower for automatically returning said third member to said normal position after said third member has been swung in one direction away from said normal position;

a third means associated with said second member and cooperating with said follower for releaseably locking said third member in another position substantially parallel to said first member; and resilient means at the outer end of said third elongated member for making contact with a door.

2. A door stop comprising:

a vertical mounting plate;

a pivot plate extending outwardly from said mounting plate and having an arcuately shaped outer periphery;

an elongated tube extending outwardly from said pivot plate in a normal position substantially perpendicular to said mounting plate;

said elongated tube having a pair of opposed rectangular slots within an inner end thereof forming a yoke, said yoke fitting around said outer periphery of said pivot plate;

means for pivotally mounting said elongated tube to said pivot plate at said inner end thereof whereby said tube is able to swing in a direction away from said normal position;

a cam follower and a spring mounted within said inner end of said elongated tube, said spring biasing said cam follower into contact with said outer periphery of said pivot plate;

a first notch formed within said outer periphery of said pivot plate, said first notch releaseably engaging said cam follower;

a cam surface formed on said outer periphery of said pivot plate, said cam surface having a configuration such that said cam follower is forced inwardly against said spring increasing the bias pressure and forcing said tube to return to its normal position; and a second notch formed within said outer periphery of said pivot plate for releaseably locking said elongated tube in a position substantially parallel to said mounting plate when said tube is swung in another direction away from its normal position.

3. A door stop according to claim 2 further including a resilient member at the other outer end of said elongated tube for making contact with a door.

4. A door stop comprising:

a first vertical member;

a second horizontal member extending outwardly from said first member and having an arcuately shaped outer periphery;

a third elongated hollow member extending outwardly from said second member in a normal position substantially perpendicular to said first member, means for pivotally mounted said third member to said second member at an inner end thereof whereby said third member is able to swing in a direction away from said normal position;

a follower moveably mounted to said inner end of said third member; and a biasing member mounted within said third member and forcing said follower member into contact with said outer periphery of said second member;

said second member having formed within said outer periphery a first notch for receiving said follower and releaseably locking said third member in said normal position, and a second notch spaced from said first notch for receiving said follower and releaseably locking said third member in a position substantially parallel to said first member when said third member is swung in a direction away from its normal position, said first and second notches being formed with smooth curved edges so as to facilitate both engagement and release of said follower.

5. A door stop according to claim 4 wherein said follower is a roller ball.

6. A door stop according to claim 4 herein said follower is a wheel.

7. A door stop according to claim 4 wherein said follower is a cone shaped pointed body.

8. A door stop according to claim 4 wherein said second member is formed on said outer periphery with a third notch spaced from said first and second notches for receiving said follower and releaseably locking said third member in another position substantially parallel to said first member, said third notch being formed with smooth curved edges so as to facilitate both engagement and release of said follower.

9. A door stop according to claim 4 wherein said second member is formed with a cam surface within said outer periphery, said cam surface having a configuration such that when said third member is swung away from its normal position, said follower is forced inwardly against said biasing member, increasing the bias pressure and forcing said third member to return to its normal position.

10. A door stop according to claim 9 wherein said means for pivotally mounting said third member includes a pivot pin passing through a pivot hole in said second member and wherein said cam surface is in the form of an arc formed about said pivot hole in such manner that the radial distance of said arc from said pivot hole increases with increasing distance from said first notch.

11. A door stop according to claim 4 wherein said first and second members are embodied in the form of an L-shaped bracket in which one leg thereof constitutes a vertical mounting plate and in which the other leg thereof constitutes a pivot plate.

12. A door stop according to claim 11 wherein said third member comprises an elongated hollow tube having a pair of opposed rectangular slots within said inner end thereof forming a yoke which fits around said outer periphery of said second member.

13. A door stop according to claim 12 wherein a cylindrical cushion rod member is telescopically mounted inside the other outer end of said elongated tube, said cushion rod member being forced at one end in an outwardly direction by said biasing member.

14. A door stop according to claim 13 wherein a resilient bumper member is attached to the other opposite end of said cushion rod member.

15. A door stop comprising:

a first vertical member;

a second horizontal member extending outwardly from said first member and having an arcuately shaped outer periphery;

a third elongated hollow member extending outwardly from said second member in a normal position substantially perpendicular to said first member, means for pivotally mounting said third member to said second member at an inner end thereof whereby said third member is able to swing in a direction away from said normal position;

a cam follower moveably mounted within said inner end of said third member; and a spring mounted within said third member and forcing said cam follower into contact with said outer periphery of said second member;

said second member having formed within its outer periphery a notch for receiving said cam follower and releaseably locking said third member in said normal position; and a cam surface disposed within said outer periphery of said second member, said cam surface having a configuration such that when said third member is sung away from its normal position, said cam follower is forced inwardly against said biasing member, increasing the bias pressure and, forcing said third member to return to its normal position.

16. A door stop according to claim 15 wherein said means for pivotally mounting said third member includes a pivot pin passing through a pivot hole in said second member and wherein said cam surface is in the form of an arc formed about said pivot hole in such manner that the radial distance of said arc from said pivot hole increases with increasing distance from said first notch.

17. A door stop according to claim 15 wherein said cam follower is a roller ball.

18. A door stop according to claim 15 wherein said cam follower is a wheel.

19. A door stop according to claim 15 wherein said cam follower is a cone shaped pointed body.

20. A door stop according to claim 15 wherein said first and second members are embodied in the form of an L-shaped bracket in which one leg thereof constitutes a vertical mounting plate and in which the other leg thereof constitutes a pivot plate.

21. A door stop according to claim 20 wherein said third member comprises an elongated hollow tube having a pair of opposed rectangular slots within said inner end thereof forming a yoke which fits around said outer periphery of said second member.

22. A door stop according to claim 21 wherein a cylindrical cushion rod member is telescopically mounted inside the other outer end of said elongated tube, said cushion rod member being forced at one end in an outwardly direction by said biasing member.

23. A door stop according to claim 22 wherein a resilient bumper member is attached to the other opposite end of said cushion rod member.

24. A door stop comprising:

a first vertical member;

a second horizontal member extending outwardly from said first member;

a third elongated member extending outwardly from said second member in a normal position substantially perpendicular to said first member, means for pivotally mounting said third member to said second member at an inner end thereof whereby said third member is able to swing in a direction away from said normal position;

a follower mounted to said inner end of said third member;

a first means associated with said second member and cooperating with said follower for releaseably locking said third member in said normal position; and a second means associated with said second member and cooperating with said follower for automatically returning said third member to said normal position after said third member has been swung in one direction away from said normal position.

25. A door stop comprising:

a first vertical member;

a second horizontal member extending outwardly from said first member;

a third elongated member extending outwardly from said second member in a normal position substantially perpendicular to said first member, means for pivotally mounting said third member to said second member at an inner end thereof whereby said third member is able to swing in a direction away from said normal position;

a moveable locking member mounted to said inner end of said third member;

biasing means urging said locking member in a direction toward said second member;

a first means associated with said second member and cooperating with said locking member for releaseably locking said third member in said normal position;

a second means associated with said second member and cooperating with said locking member for releaseably locking said third member in a first position substantially parallel to said first member;

a third means associated with said second member and cooperating with said locking member for releaseably locking said third member in a second position substantially parallel to said first member;

a cushion rod telescopically mounted inside the other outer end of said third elongated member, said cushion rod being urged in an outward direction by said bias means; and a resilient bumper attached to the outer end of said cushion rod for making contact with a door.

26. A door stop comprising:

an L-shaped bracket one leg of which comprises a vertical mounting plate and the other leg of which comprises a pivot plate, said pivot plate having an arcuately shaped outer periphery;

an elongated tube having a pair of opposed rectangular slots within an inner end thereof forming a yoke, said yoke fitting around said outer periphery of said pivot plate;

said tube extending outwardly from said pivot plate in a normal position substantially perpendicular to said mounting plate, said tube being pivotally mounted to said pivot plate at an inner end thereof whereby said tube is able to swing in a direction away from said normal position;

a cam follower and a spring mounted within said inner end of said tube, said spring biasing said cam follower into contact with said outer periphery of said pivot plate;

a notch formed within said outer periphery of said pivot plate for receiving said cam follower and releaseably locking said tube in said normal position;

said cam follower engaging said notch for releaseably locking said tube in said normal position;

a cylindrical cushion rod member telescopically mounted inside the other outer end of said elongated tube, said cushion rod member being biased at one end in an outwardly direction by said spring;

a resilient bumper member attached to the other opposite end of said cushion rod member.

said cushion rod having a slot in the inner end thereof and a retainer pin traversing said slot; and a guide pin extending through said elongated tube and said slot, said guide pin being positioned behind said retainer pin so as to limit the movement of said cushion rod member outwardly through said outer end of said tube.

27. A door stop according to claim 26 wherein a pair of coil springs are provided within said elongated tube, one of which biases said cam follower into contact with said outer periphery of said pivot plate and the other of which biases said cushion rod in an outwardly direction at said outer end of said tube.

* * * * *